United States Patent [19]

Boiko

[11] Patent Number: 4,789,407

[45] Date of Patent: Dec. 6, 1988

[54] METHOD TO DISSOLVE HYDRATED ALUMINUM HYDROXIDE GEL IN POTABLE HOT WATER HEATERS

[75] Inventor: Robert S. Boiko, Glenview, Ill.

[73] Assignee: Tri-Brothers Chemical Corporation, Northbrook, Ill.

[21] Appl. No.: 94,845

[22] Filed: Sep. 10, 1987

[51] Int. Cl.[4] ..... B08B 3/08

[52] U.S. Cl. ..... 134/22.1; 134/3; 134/28; 134/41; 423/132

[58] Field of Search ..... 423/132; 134/22.1, 28, 134/3, 41

[56] References Cited

U.S. PATENT DOCUMENTS 2,424,049 7/1947 Parker ..... 134/28
4,515,641 5/1985 Juenger ..... 134/22.1

FOREIGN PATENT DOCUMENTS 2520988 11/1975 Fed. Rep. of Germany ..... 134/28

*Primary Examiner*—Asok Pal
*Attorney, Agent, or Firm*—Emrich & Dithmar

[57] ABSTRACT

A method of dissolving aluminum hydroxide gel formed in situ in water heaters having aluminum anode rods therein, comprising contacting the aluminum hydroxide gel with phosphoric acid, said phosphoric acid being present in the range of from about 9% to about 35% by volume at a temperature in the range of from about 138° F. to about 160° F.

2 Claims, No Drawings

METHOD TO DISSOLVE HYDRATED ALUMINUM HYDROXIDE GEL IN POTABLE HOT WATER HEATERS

BRIEF SUMMARY

The invention is a method to dissolve the gel form of aluminum hydroxide formed in some hot water heaters. Phosphoric acid is combined with heat in specific concentrations and temperatures.

Phosphoric acid will not dissolve the aluminum hydroxide without the proper heat, and at the incorrect concentrations, phosphoric acid will attack the metal of the tank and cause damage due to contact times which are too long.

The concentrations must also be sufficient to dissolve the aluminum hydroxide when the total volume of phosphoric solution in the tank can be two through five gallons.

Another factor which must be accounted for is the use of the one time energy cutoff safety switch in most residential gas water heater thermostats such as the thermostats produced by the White-Rodgers Company. These safety switches open at about 185° F. When the switch opens, the pilot light goes out and cannot be relit until the thermostat is replaced.

The safety of the procedure is very important since people who are not professional in the field of maintenance will probably be involved with this procedure.

DETAILED DESCRIPTION

The development of symptoms that aluminum hydroxide gel is present inside a water heater tank, especially gas fired, burner at the bottom usually occurs after about 110 grams of aluminum has reacted from the anode rod. This is equal to about 312 grams of aluminum hydroxide.

Using the percentages of phosphoric acid from U.S. Pat. No. 3,424,688, and dissolving reagent grade calcium carbonate along with tests of elevated temperature effects on aluminum hydroxide, it appears that the ionization into the conjugate base and hydronium ions does not appreciably exceed the first stage or $H_3PO_4 + H_2O = H_3O + H_2PO_4$. Furthermore, when checking actual reaction quantities against calculated quantities, only about 45% of the material dissolved compared to what should have dissolved if 100% of the $H_2PO_4^-$ reacted with the aluminum hydroxide, or the calcium carbonate.

In order to assure the production of only aluminum di hydrogen phosphate [$Al(H_2PO_4)_3$] which is more soluble than Aluminum phosphate [$Al_3(PO_4)_2$] and to keep contact times with the tank at a minimum, the lower limit of concentration was determined to be 9% $H_3PO_4$ by volume to 91% $H_2O$ by volume. In this amount each gallon dissolves approximately 200 grams of aluminum hydroxide at elevated temperatures. The reaction takes about 12 minutes so that contact time is not excessive. At lower concentrations contact time is too long and damage to the steel is the result, especially if this procedure is used regularly. In smaller tanks or electric models of water heaters that may only need 2–3 gallons of solution, this would be sufficient to dissolve the normal amount of 300–400 grams aluminum hydroxide present.

The upper limit concentration of phosphoric acid in water was determined to be 35%. The Food and Drug Administration places this as the highest allowable concentration at which phosphoric acid is classified as only an irritant. This concentrating also approaches an amount where the reaction speed is not reduced in relation to the expense of the material.

The water heater manufacturers produce tanks with a maximum of 4 anode rods. In very reactive water the anods could release almost 1 pound of the aluminum hydroxide each. At 35% $H_3PO_4$ the amount of 5 gallons solution would dissolve the aluminum hydroxide gel. Experiments have shown contact time would only need to be about 6.5 minutes.

The other factor which must be linked to concentrations is the temperature of the phosphoric acid solution. The minimum allowable temperature needed to allow the shortest contact time is 138° F. The maximum temperature would be 160° F. Below 138° F. the steel is attached quickly compared to the aluminum hydroxide gel. The solution must remain in the tank for extended periods. About 160° F. not only is the steel once again attacked faster than the aluminum hydroxide gel, but thermostats with one time energy cut off switches may be destroyed.

In gas fired hot water heaters the following method may be used and refined for each model by the individual manufacturer.

For units with the burner at the bottom the following applies. The amount of solution that can be added without directly contacting the aluminum anode rod is determined, such as 2½ gallons. The heat rise needed would normally be about 80° F. if the solution temperature is 70° F. and the desired solution temperature is 150° F. The input firing rate of the burner is multiplied by the percent efficiency of heat transferred at the bottom. This translates into the actual b.t.u. output which can then be calculated by minutes to achieve the final correct temperature.

As an example using a specific heat of 1. Burner input 35,000 b.t.u.'s output at 65% efficiency 22,750 b.t.u.'s/hr. or 379.17 b.t.u's/minute. 2.5 gallons raised 80° F. need 1666 b.t.u's so the burner would need to fire for about 4.4 minutes to heat the solution to 150° F. Since the solution only need about 12 minutes contact time above 138° F., further reheating is not needed because the temperature will not fall below 138° F. in that short time period.

In the case of submerged burner water heaters such as the Mor-Flo or A. O. Smith special models, the solution would need to cover the chamber which could cause contact with the anode rod. At 35% $H_3PO_4$ concentration in water we tested for volume of hydrogen gas evolution. It was found that after 7 minutes contact time at 160° F. about 4.5 liter of hydrogen were produced which can be safely dispersed via normal venting through the removed relief valve opening and normal prudence of removing ignition sources from the area of the opening.

In the case of electric hot water heaters, the safest method would be to preheat the solution before introduction into the drained tank, since heating elements not submerged in liquid could dry fire and melt. Some electric units have only one element at the bottom, and if this element is submerged can be turned on to heat the solution. A 240 volt 4500 watt element would supply 256 b.t.u's per minute to the solution.

The steel weight loss for longer contact times within the range of this patent averaged 0.02 grams per square inch after 12 minutes duration. When concentrations were raised to the median and above portions of the patent amounts, steel weight loss averaged 0.015 grams per square inch due to the shorter contact times needed which were about 7 minutes.

I claim:

1. A method of dissolving aluminum hydroxide gel formed in situ in water heaters having aluminum anode rods therein, comprising contacting the aluminum hydroxide gel with phosphoric acid, said phosphoric acid being present in the range of from about 9% to about 35% by volume at a temperature in the range of from about 138° F. to about 160° F.

2. The method of claim 1, wherein the phosphoric acid remains in contact with the aluminum hydroxide gel for a time not to exceed about 12 minutes at the elevated temperature.

* * * * *